US008456268B2

(12) United States Patent
Song

(10) Patent No.: US 8,456,268 B2
(45) Date of Patent: Jun. 4, 2013

(54) MAGNETIC COIL ASSEMBLY

(75) Inventor: Ki Bong Song, Cheongju (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 13/355,435

(22) Filed: Jan. 20, 2012

(65) Prior Publication Data

US 2012/0188044 A1 Jul. 26, 2012

(30) Foreign Application Priority Data

Jan. 26, 2011 (KR) ..... 20-2011-0000767 U

(51) Int. Cl.
*H01F 27/29* (2006.01)

(52) U.S. Cl.
USPC ..... 336/192; 336/198

(58) Field of Classification Search
USPC ..... 336/65, 196, 198, 192, 200
See application file for complete search history.

(56) References Cited

U.S. PATENT DOCUMENTS

| | | | | |
|---|---|---|---|---|
| 5,546,061 | A | 8/1996 | Okabayashi et al. | |
| 6,515,567 | B2 * | 2/2003 | Yeh et al. | 336/192 |
| 2007/0241847 | A1 | 10/2007 | Yamamoto et al. | |
| 2009/0243771 | A1 | 10/2009 | Uruma et al. | |

* cited by examiner

*Primary Examiner* — Tuyen Nguyen
(74) *Attorney, Agent, or Firm* — Lee, Hong, Degerman, Kang & Waimey

(57) ABSTRACT

The present disclosure provides a magnetic coil assembly for suppressing the generation of broken wire in a coil as well as reducing a winding time, the magnetic coil assembly according to the present disclosure comprise a bobbin; a magnetic coil wound around the bobbin; a pair of terminals fixedly installed at the bobbin; a first coil fixing protrusion portion extended from the terminal to fix a starting end portion of a first coil half which is a half of the entire length of the magnetic coil; a second coil fixing protrusion portion extended from the bobbin to fix a starting end portion of a second coil half which is the remaining half of the magnetic coil, and fix an terminal end portion of the first coil half; and a third coil fixing protrusion portion extended from the terminal to fix a terminal end portion of the second coil half.

2 Claims, 7 Drawing Sheets

MAGNETIC COIL ASSEMBLY

CROSS-REFERENCE TO RELATED APPLICATION

Pursuant to 35 U.S.C. §119(a), this application claims the benefit of earlier filing date and right of priority to Korean Utility Model Application No. 20-2011-0000767, filed on Jan. 26, 2011, the contents of which is incorporated by reference herein in its entirety.

BACKGROUND OF THE INVENTION

1. Field of the Invention

The present disclosure relates to a magnetic contactor, and more particularly, to a magnetic coil assembly for the magnetic contactor.

2. Description of the Conventional Art

Referring to FIG. 1, in general, the externally exposed portion of a magnetic contactor 100 may be largely divided into an upper frame 10 and a lower frame 20.

A typical magnetic contactor 100 in FIG. 1 may include a fixed core 1, a movable core 4, a coil 33, a bobbin 31, a cross bar 8, a movable contact 6, stationary contact 7, and a return spring 9, which are accommodated into the upper frame 10 and lower frame 20, referring to FIG. 2 as an internal configuration.

The fixed core 1 may be fixed and provided at an internal bottom surface of the lower frame 20, and configured with a divided "E"-shaped iron core. The bobbin 31 may be inserted into a central portion of the "E"-shaped fixed core 1, and the coil 33 may be wound around the bobbin 31. Accordingly, the fixed core 1 is magnetized while magnetizing the coil 33 when electrical current flows into the coil 33 of the bobbin 31 being inserted into the central portion, and the fixed core 1 is demagnetized when the flow of electrical current flowing into the coil 33 is terminated.

The movable core 4 may be provided in a vertically movable manner at an upper portion facing the fixed core 1, and the return spring 9 may be normally provided between the bobbin 31 and movable core 4 to exert an elastic force to the movable core 4 in the direction of leaving from the fixed core 1, namely, in an upward direction in FIG. 2.

The cross bar 8 may be combined with the movable core 4 integrally at an upper portion of the movable core 4, thereby allowing them to be movably provided together in a vertical direction. Three movable contacts 6 corresponding to alternating current three-phases(three-poles) are installed at the cross bar 8 to be supported by the cross bar 8, allowing the movable cross bar 8 to be moved together, and three stationary contacts 7 corresponding to alternating current three-phases are provided in a fixed manner at a position facing the movable contact 6. The operation is of a typical magnetic contactor 100 having the foregoing configuration will be described in brief with reference to FIG. 2.

Referring to FIGS. 3 and 4, if a control signal is applied to terminals 32*a*, 32*b* which will be described later, then the fixed core 1 is magnetized as a current of the control signal flows into the coil 33, and therefore, the movable core 4 and cross bar 8 move downward while overcoming an elastic force of the return spring 9 in FIG. 2 as the facing movable core 4 is attracted by a magnetic force, thereby allowing a bottom surface of the movable core 4 and an upper surface of the fixed core 1 to be brought into contact with each other. At this time, the movable contact 6 being supported by the cross bar 8 is brought into contact with the corresponding stationary contact 7. Accordingly, when an electric power source and a motor are connected to the stationary contact 7, the electric power is supplied to the motor from the electric power source by the magnetic contactor.

If the application of a control signal to terminals 32*a*, 32*b* which will be described later is terminated with reference to FIGS. 3 and 4, then the fixed core 1 is demagnetized as a current does not flow into the coil 33, and therefore, the facing movable core 4 is separated from the fixed core 1 by an elastic force of the return spring 9. At this time, the movable contact 6 being supported by the cross bar 8 is separated from the corresponding stationary contact 7. Accordingly, when the electric power source and the motor are connected to the stationary contact 7, the electric power supplied to the motor from the electric power source is broken by the magnetic contactor.

A magnetic coil assembly providing a driving force of the movable core 4 in the foregoing magnetic contactor 100 according to an example of the related art will be described with reference to FIGS. 3 and 4.

FIG. 3 is a perspective view illustrating a magnetic coil assembly in a state that a coil is not wound in a magnetic coil assembly according to the related art, and FIG. 4 is a perspective view illustrating a magnetic coil assembly in a state that a coil is wound in a magnetic coil assembly according to the related art. As illustrated in the drawing, a magnetic coil assembly 30 according to the related art is largely divided into a bobbin 31, terminals 32*a*, 32*b*, and a coil 33.

Referring to FIG. 3, the bobbin 31 is made of an electrical insulating material such as synthetic resin, and typically may include a square pillar shaped body portion having an internal hollow portion and flange portions formed at both end portions in a length direction of the body portion. An upper flange portion of the flange portions may include a pair of extension portions extended lengthways in one direction to install the terminals 32*a*, 32*b*, and an insulating partition portion for electrically insulating the both terminals 32*a*, 32*b* from each other and from the other elements of the magnetic contactor. The extension portion may have a terminal supporting groove portion extended by a predetermined gap to press and support the body portion of terminals 32*a*, 32*b* therebetween.

The terminals 32*a*, 32*b* are made of an electrical conductor connected to a conducting wire that provides the control signal of the magnetic contactor 100, and may include a head portion for connecting a wire which is easily seen in FIG. 3, a elongate body portion extended from the head portion, and a first coil fixing protrusion portion 32*a*-1 bent at a right angle in a horizontal direction from the body portion to be connected with a starting end portion of the wound coil 33.

A connection between the coil 33 and first coil fixing protrusion portion 32*a*-1 and their connection maintenance may be typically achieved using the method of winding a starting end portion of the coil 33 around the first coil fixing protrusion portion 32*a*-1 with one or two turns and then soldering and fixing it.

The terminal 32*b* also has a configuration similar to the terminal 32*a* which is easily seen in FIG. 3, and may include a head portion for connecting a wire, a elongate body portion extended from the head portion, and a terminating coil connecting end portion (not shown) bent at a right angle in a horizontal direction from the body portion to be connected with an terminal end portion of the wound coil 33.

The method of winding the coil 33 around the bobbin 31 may be achieved by connecting and rotating the bobbin with a power transmission shaft of a motor in a state that the starting end portion is connected and fixed to the first coil fixing protrusion portion 32*a*-1 as described above. At this time, the number of rotations of the motor, i.e., bobbin, is proportional to the amount of coil wrapped around the bobbin, and a time for winding the coil increases as increasing the amount of coil being wrapped. As a result, when a winding time is reduced by increasing the rotation speed of the motor, it may cause a problem of broken wire while winding the coil.

SUMMARY OF THE INVENTION

Accordingly, the present disclosure is contrived to solve the problems in the related art, and an object of the present disclosure is to provide a magnetic coil assembly for suppressing the generation of broken wire in a coil as well as reducing a winding time.

The objective of the present disclosure may be accomplished by providing a magnetic coil assembly, comprising:

a bobbin;

a magnetic coil wound around the bobbin;

a pair of terminals fixedly installed at the bobbin;

a first coil fixing protrusion portion extended from the terminal to fix a starting end portion of a first coil half which is a half of the entire length of the magnetic coil;

a second coil fixing protrusion portion extended from the bobbin to fix a starting end portion of a second coil half which is the remaining half of the magnetic coil, and fix an terminal end portion of the first coil half; and a third coil fixing protrusion portion extended from the terminal to fix a terminal end portion of the second coil half.

And according to a preferred aspect of the present disclosure, the bobbin is provided with a guide groove portion configured to guide an terminal end portion of the second coil half.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The objective of the present disclosure, as well as the configuration and working effect thereof to accomplish the foregoing objective will be clearly understood by the following description for the preferred embodiments of present disclosure with reference to the accompanying drawings.

Figure 1:
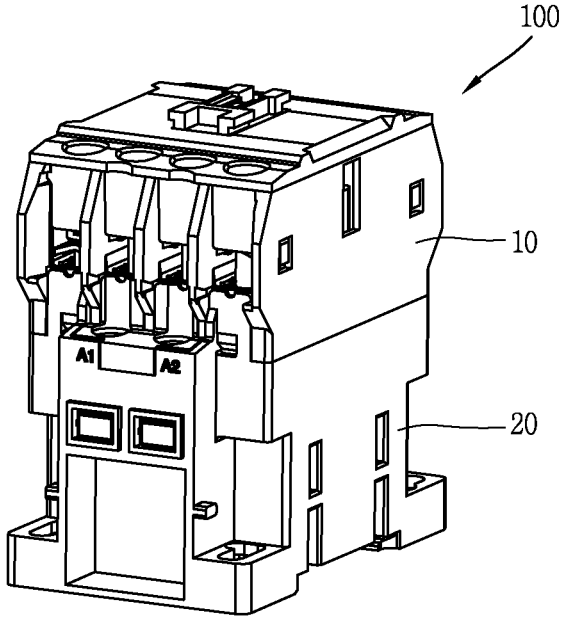
FIG. 1 RELATED ART
FIG. 1 is a perspective view illustrating the external appearance of a typical magnetic contactor.
Figure 2:
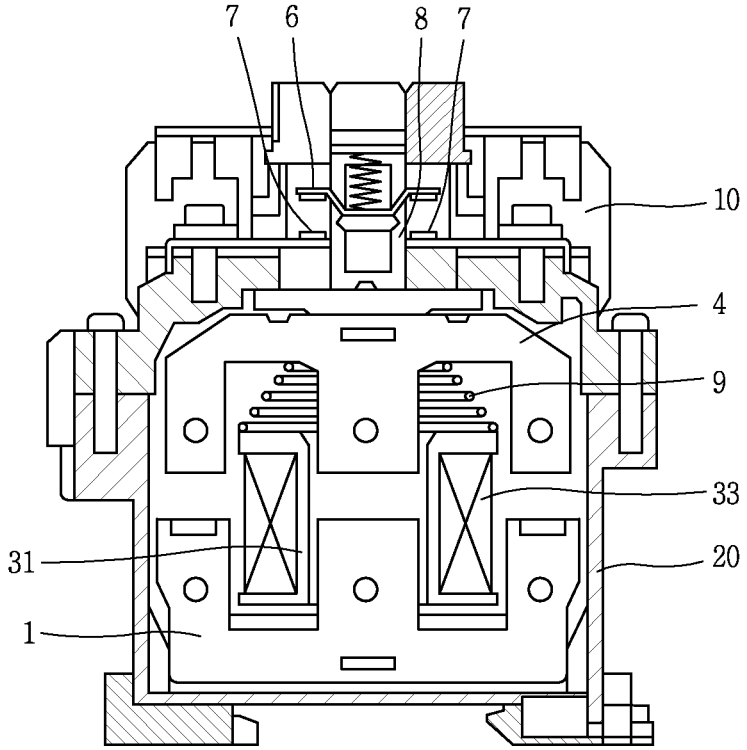
FIG. 2 RELATED ART
FIG. 2 is a longitudinal cross-sectional view illustrating the internal structure of a magnetic contactor in FIG. 1.
Figure 3:
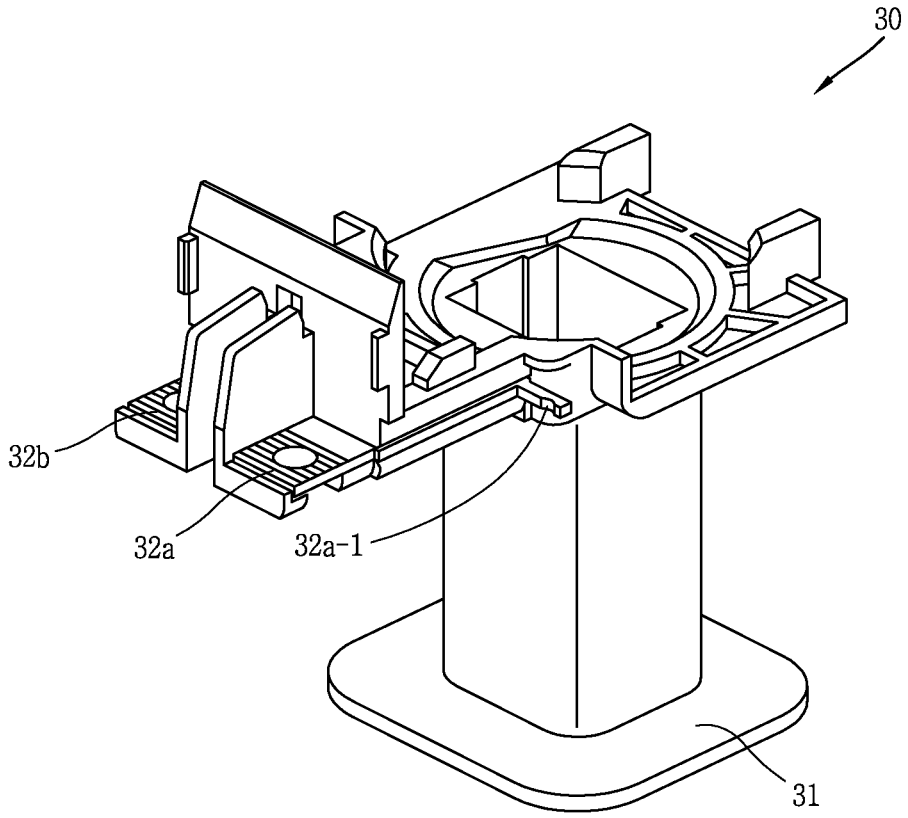
FIG. 3 RELATED ART
FIG. 3 is a perspective view illustrating a magnetic coil assembly in a state that a coil is not wound in a magnetic coil assembly according to the related art.
Figure 4:
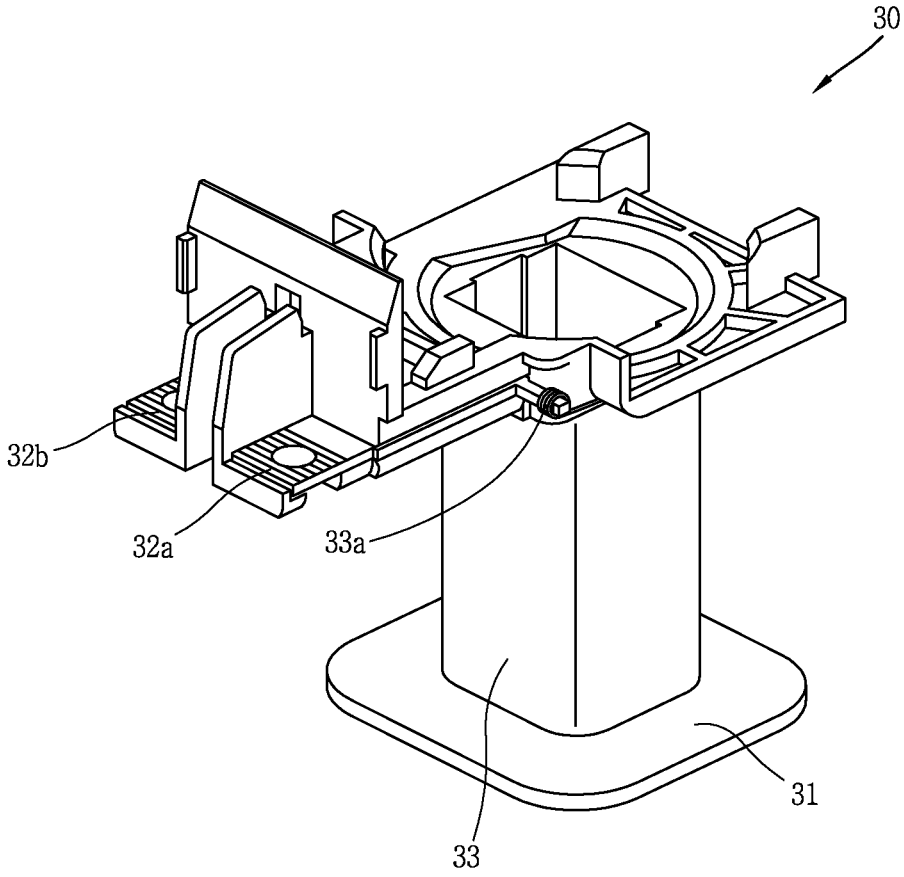
FIG. 4 RELATED ART
FIG. 4 is a perspective view illustrating a magnetic coil assembly in a state that a coil is wound in a magnetic coil assembly according to the related art.
Figure 5:
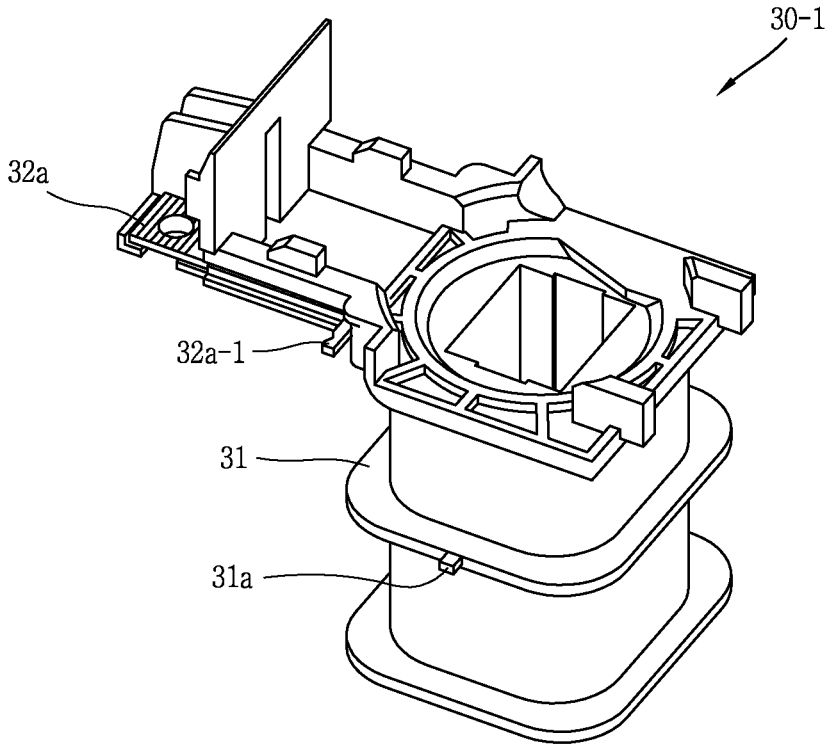
FIG. 5 is a perspective view as obliquely viewed from the upper left side illustrating a magnetic coil assembly in a state that a coil is not wound in a magnetic coil assembly according to the present disclosure.
Figure 6:
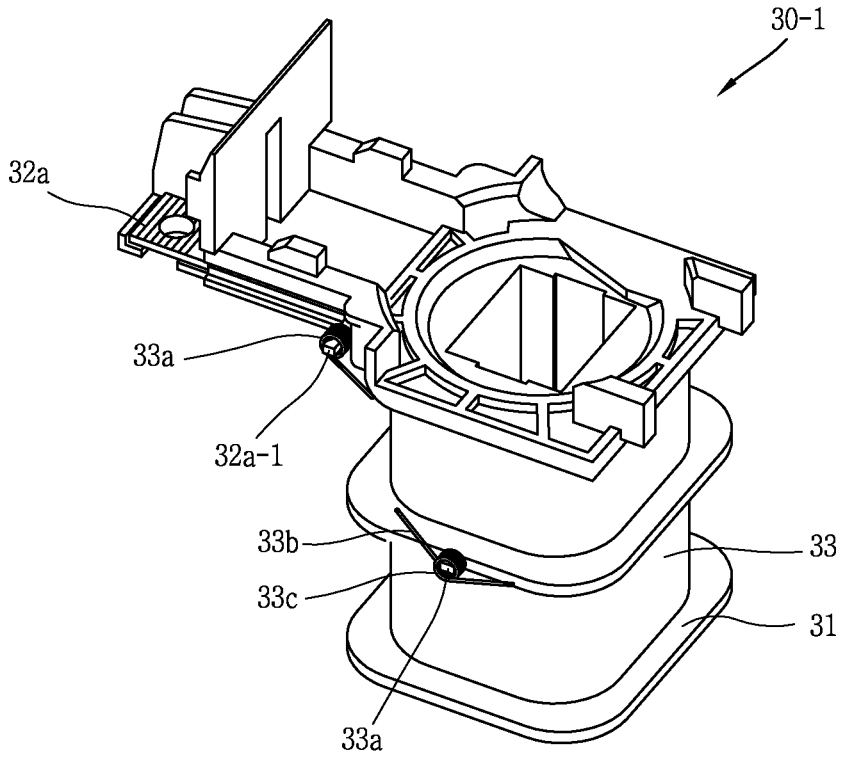
FIG. 6 is a perspective view as obliquely viewed from the upper left side illustrating a magnetic coil assembly in a state that a coil is wound in a magnetic coil assembly according to the present disclosure.
Figure 7:
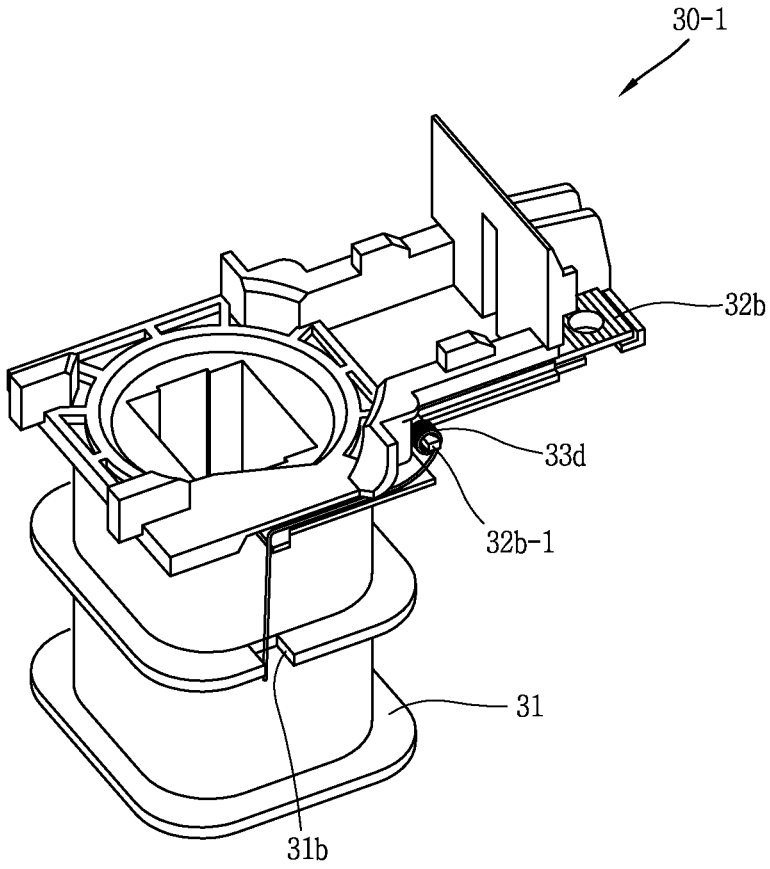
FIG. 7 is a perspective view as obliquely viewed from the upper right side illustrating a magnetic coil assembly in a state that a coil is wound in a magnetic coil assembly according to the present disclosure.

Referring to FIGS. 5 through 7, a magnetic coil assembly 30-1 according to a preferred embodiment of the present disclosure comprises a bobbin 31, a magnetic coil 33, a pair of terminals 32*a*, 32*b*, a first coil fixing protrusion portion 32*a*-1, a second coil fixing protrusion portion 31*a*, and a third coil fixing protrusion portion 32*b*-1.

The bobbin 31 is made of an electrical insulating material such as synthetic resin, and typically comprises a square pillar shaped body portion having an internal hollow portion and flange portions formed at both end portions in a length direction of the body portion. An upper flange portion of the flange portions comprises a pair of extension portions extended lengthways in one direction to install the terminals 32*a*, 32*b*, and an insulating partition portion for electrically insulating the both terminals 32*a*, 32*b* from each other and from the other elements of the magnetic contactor. In particular, the extension portion may have a terminal supporting groove portion extended by a predetermined gap to press and support the body portion of terminals 32*a*, 32*b* therebetween.

The magnetic coil 33 is a coil which is wound around the bobbin 31, and magnetized or demagnetized according to the conduction or non-conduction state of a control current, namely, become an electromagnet, to generate a magnetic force for attracting a movable core to a fixed core.

The pair of terminals 32*a*, 32*b* are terminals fixedly installed at the bobbin 31, to which a signal line providing the control current to receive the control current for controlling magnetization or demagnetization of the magnetic coil 33 from an external signal source can be connected, in a magnetic coil assembly 30-1 according to a preferred embodiment of the present disclosure.

The first coil fixing protrusion portion 32*a*-1 is a protrusion portion extended from the first terminal 32*a* in the side direction to fix a starting end portion of a first coil half which is a half (divided by 2) of the entire length of the magnetic coil 33, referring to FIG. 5.

Referring to FIG. 5, a second coil fixing protrusion portion 31*a* is extended from the bobbin 31 (more specifically, from a lateral surface of an upper flange of the bobbin in the side direction) to provide a means for fixing a starting end portion of a second coil half which is the remaining half of the magnetic coil 33, and fixing a terminal end portion of the first coil half, referring to FIG. 6.

Referring to FIG. 7, a third coil fixing protrusion portion 32*b*-1 is extended from the second terminal 32*b* to provide a means for fixing a terminal end portion of the second coil half. The shape of the third coil fixing protrusion portion 32*b*-1 in a state that the magnetic coil 33 is not wound around the third coil fixing protrusion portion 32*b*-1 is similar to that of the first coil fixing protrusion portion 32*a*-1 illustrated in FIG. 5, and thus will be referred to as the description thereof.

Furthermore, a magnetic coil assembly 30-1 according to a preferred embodiment of the present disclosure may further include a guide groove portion 31*b* formed on the bobbin 31 to guide an terminal end portion of the second coil half.

The operation of a magnetic coil assembly 30-1 having the foregoing configuration according to a preferred embodiment of the present disclosure will be described with reference to FIGS. 5 through 7.

The magnetic coil assembly 30-1 according to a preferred embodiment of the present disclosure is a magnetic coil assembly capable of rapidly and reliably winding the magnetic coil 33, and thus the magnetic coil 33 will be described for the operation of winding the magnetic coil 33 to the a magnetic coil assembly 30-1 according to a preferred embodiment of the present disclosure, but the operation of attracting or releasing a movable core based on magnetization or demagnetization being exerted by the magnetic coil assembly 30-1 mounted on the magnetic contactor has been described in the background art, and thus the description thereof will be omitted.

First, as illustrated in FIG. 5, devices except the magnetic coil 33 in the magnetic coil assembly 30-1 according to a preferred embodiment of the present disclosure is prepared.

Then, a power transmission shaft of a motor is inserted into a hollow portion of the bobbin 31.

Then, a starting point of the first coil half and the second coil half in the magnetic coil 33 is fixed to the first coil fixing protrusion portion 32*a*-1 and the second coil fixing protrusion portion 31*a*. For the fixing method, soldering, adhesion or the like may be alternatively used.

Then, the first coil half and the second coil half are wound simultaneously, namely, in parallel, around a body portion of the bobbin 31 by rotating the motor.

If both the first coil half and the second coil half are wound around a body portion of the bobbin 31, then a terminal end portion of the first coil half is fixed to the second coil fixing protrusion portion 31*a* using a method such as soldering, adhesion, or the like, and a terminal end portion of the second coil half is drawn out upward through the guide groove portion 31*b* and fixed to the third coil fixing protrusion portion 32*b*-1 of the second terminal 32*b* using a method such as soldering, adhesion, or the like, thereby completing the operation of winding the magnetic coil 33 to the a magnetic coil assembly 30-1 according to a preferred embodiment of the present disclosure.

The present disclosure has a configuration in which the entire length of the magnetic coil 33 is divided by 2 to wind the coil in parallel around the bobbin 31, and thus the number of windings can be reduced to ½ compared to the related art in which the number of rotations in a winding motor is sequentially wound in series, thereby obtaining an effect of drastically reducing the fabrication time of a magnetic coil assembly.

According to the present disclosure, the bobbin 31 is provided with a guide groove portion 31*b* configured to guide an terminal end portion of the second coil half, thereby obtaining an effect that the terminal end portion of the second coil half can be guided while being linearly protected within the guide groove portion 31*b* of the bobbin 31.

The present disclosure has a configuration in which the entire length of the magnetic coil is divided by 2 to wind the coil in parallel around the bobbin, and thus the number of windings can be reduced to ½ compared to the method in which the number of rotations in a winding motor is sequentially wound in series, thereby obtaining an effect of drastically reducing the fabrication time of a magnetic coil assembly.

According to the present disclosure, the bobbin is provided with a guide groove portion configured to guide an terminal end portion of the second coil half, thereby obtaining an effect that the terminal end portion of the second coil half can be guided while being linearly protected within the guide groove portion of the bobbin.

What is claimed is:

1. A magnetic coil assembly for a magnetic contactor, comprising:

a bobbin;

a magnetic coil wound around the bobbin;

a pair of terminals fixedly installed at the bobbin;

a first coil fixing protrusion portion extended from the terminal to fix a starting end portion of a first coil half which is a half of the entire length of the magnetic coil;

a second coil fixing protrusion portion that extends from the bobbin to fix a starting end portion of a second coil half which is the remaining half of the magnetic coil, and to fix a terminal end portion of the first coil half so that the first coil half may be connected to the second coil half electrically; and a third coil fixing protrusion portion extended from the terminal to fix a terminal end portion of the second coil half.

2. The magnetic coil assembly of claim 1, wherein the bobbin is provided with a guide groove portion configured to guide an terminal end portion of the second coil half.

* * * * *